US009615667B2

(12) United States Patent
Schlanker

(10) Patent No.: US 9,615,667 B2
(45) Date of Patent: Apr. 11, 2017

(54) PRINTABLE INTERCHANGEABLE VERTICALLY RETRACTABLE FRONT COVER SYSTEM FOR MURPHY BEDS

(71) Applicant: Greg Winston Schlanker, Rockvale, TN (US)

(72) Inventor: Greg Winston Schlanker, Rockvale, TN (US)

( * ) Notice: Subject to any disclaimer, the term of this patent is extended or adjusted under 35 U.S.C. 154(b) by 249 days.

(21) Appl. No.: 14/490,245

(22) Filed: Sep. 18, 2014

(65) Prior Publication Data

US 2016/0084000 A1 Mar. 24, 2016

(51) Int. Cl.

| | |
|---|---|
| ***A47C 17/38*** | (2006.01) |
| ***E06B 9/11*** | (2006.01) |
| ***E06B 9/40*** | (2006.01) |

(52) U.S. Cl.

CPC ..... *A47C 17/38* (2013.01); *E06B 9/115* (2013.01); *E06B 9/40* (2013.01)

(58) Field of Classification Search

CPC ..... A47C 17/38

USPC ..... 5/2.1, 8, 133, 136, 163, 164.1

See application file for complete search history.

(56) References Cited

U.S. PATENT DOCUMENTS

| | | | | |
|---|---|---|---|---|
| 261,617 A * | 7/1882 | Lozier | A47C 19/22 5/136 |
| 1,174,341 A * | 3/1916 | Nathoo | A47C 17/40 5/137 |
| 1,234,067 A * | 7/1917 | Negrete | A47C 17/40 5/141 |
| 2,724,128 A | 11/1955 | Schultz | |
| 7,793,366 B2 | 9/2010 | Stoltzfus | |

* cited by examiner

*Primary Examiner* — Fredrick Conley
(74) *Attorney, Agent, or Firm* — Dunlap Bennett & Ludwig PLLC

(57) ABSTRACT

A printable interchangeable vertically retractable front cover system for a Murphy bed may provide a cover assembly, a cover framing assembly, a cover drive assembly, and a Murphy bed assembly. The cover assembly may vertically deploy to conceal a Murphy bed in the upright position and may vertically retract for the bed frame and mattress to be lowered to the floor. The cover assembly may include a positionable cover having a continuous seamless printable surface that may accept high resolution printed imagery such as photographs and artwork. The cover may vertically retract and deploy with the aid of its own drive assembly. The positionable cover may either roll up or fold up into a compact cover assembly which may be uniquely removably mounted to the cover framing assembly to allow for quick and easy transition from one cover assembly to another, thus making it uniquely interchangeable. For the first time, a Murphy bed owner may have the ability to quickly update the appearance of his or her stowed Murphy bed, such as with changing seasons, styles or interests.

19 Claims, 4 Drawing Sheets

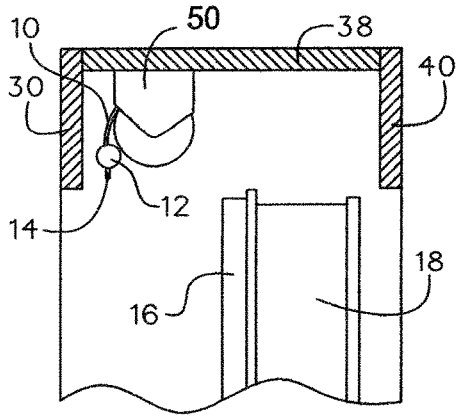
FIG.11
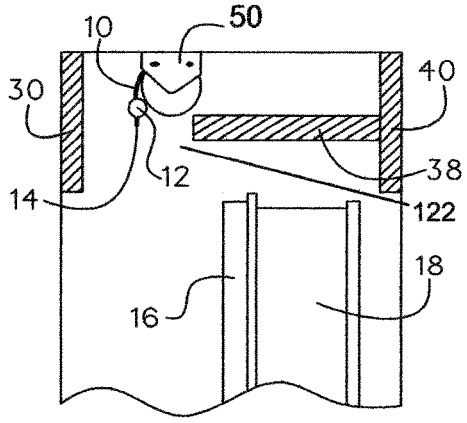
FIG.12
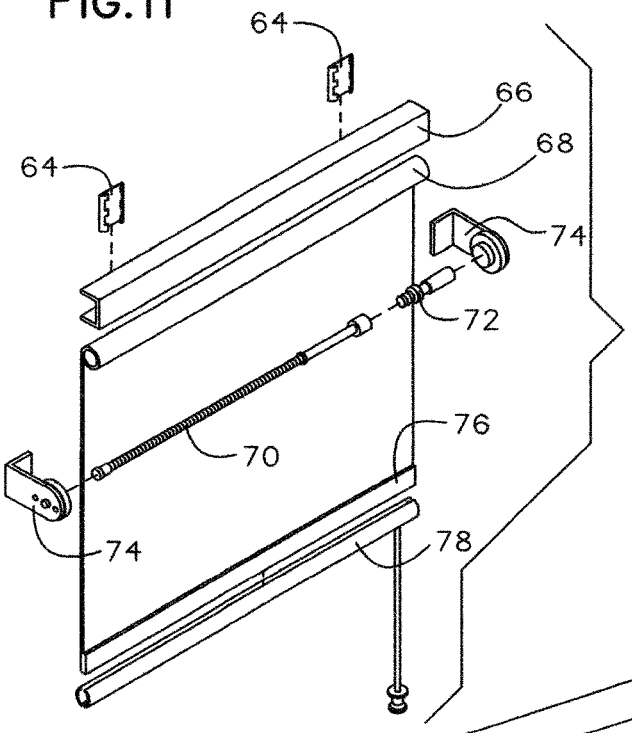
FIG.13
(PRIOR ART)
130
FIG.14
(PRIOR ART)
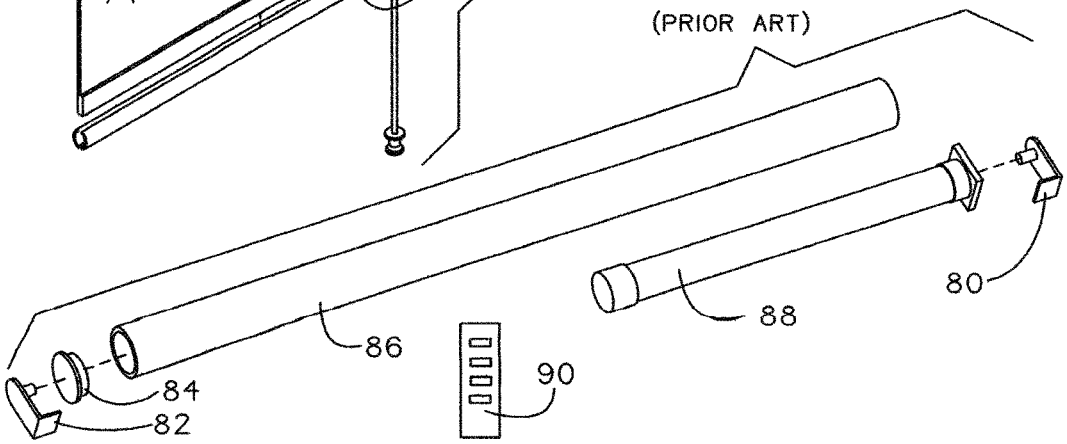

PRINTABLE INTERCHANGEABLE VERTICALLY RETRACTABLE FRONT COVER SYSTEM FOR MURPHY BEDS

BACKGROUND OF THE INVENTION

The present invention relates to Murphy beds (also known as wall beds) and, more particularly, to a printable, interchangeable, vertically-retractable, front cover system for Murphy beds.

Murphy beds typically utilize two types of pre-existing front cover systems to conceal a Murphy bed frame and mattress: bi-fold doors or front structural panels. Unfortunately, such cover systems are not designed to print on in order to provide a custom printed appearance. Additionally, due to their weight and bulk these covers are not simple to install or replace and often add strain to the Murphy bed's lifting device.

Current front cover systems do not provide a good surface to print on to achieve a unique printed appearance. Commonly, such front cover systems have a number of gaps, noticeable seams or uneven surfaces between door or panel sections; as a result, in order to customize them with printed imagery, one would have to contend with the lack of continuity of the printing surface. Moreover, if one were to apply a continuous fabric or seamless material to the panels of a panel style Murphy bed, one would have to consider that the panels, and thus the applied fabric or material, would often remain suspended horizontally when the Murphy bed frame is deployed, thus the materials would likely separate or sag over time.

Current front cover systems are cumbersome to work with due to their weight and bulk. Today, front cover systems do not vertically retract overhead into a compact lightweight unit independent of the Murphy bed frame to allow for simple installation and replacement and thus interchangeability. Moreover, they require many screws and/or hinges to attach/detach and they do not roll up or fold up into a convenient space saving package to be stored for use at a later time. In the case of the panel style front covers on panel style Murphy beds, they add stress to the Murphy bed's lifting mechanism because they are attached to the bed frame itself. In the case of bi-fold doors, they are bulky and may be in the way of the end user when the doors are partially open, for example when side cabinets do not allow the doors to swing completely back. They require additional available wall space to swing completely back against the side panels of the Murphy bed assembly. The weight and bulk of the existing front cover systems increase the difficulty and cost of handling, transporting, installing, removing and replacing. With these characteristics, current Murphy bed front covers are generally considered to be a permanent component of the Murphy bed assembly.

As can be seen, there is a need for a Murphy bed front cover system that is lightweight, printable, interchangeable, and vertically retractable.

OBJECTIVES OF THE PRESENT INVENTION

The objectives of the present invention include providing a printed customized look on the front face of an upright Murphy bed by providing a front cover system that is effectively printable. The system will include a continuous seamless printable cover that is vertically retractable.

Another objective of the present invention is that the front cover system is lightweight and vertically retractable by being rolled or folded up overhead with the aid of its own drive assembly, so as to be independent of the Murphy bed frame operation: completely out of the way of the consumer when retracted and not adding strain on the Murphy bed's lifting device.

An additional objective of the present invention is a front cover system that is removably connected to the Murphy bed assembly by providing a cover framing assembly or another simple attachment component. The front cover system will not be connected to the Murphy bed frame portion of the Murphy bed assembly. The cover framing assembly enables interchangeability of the front cover system to allow the consumer the opportunity to easily update the appearance of their Murphy bed without the use of tools.

SUMMARY OF THE INVENTION

The present invention is a printable, interchangeable, vertically retractable front cover system for a Murphy bed. The invention combines various aspects or elements to provide a removable front cover system that may be adorned with high resolution digital printed imagery such as sports team logos, scenic pictures, and family photographs. The cover once retracted with the aid of its own drive assembly is reduced to a lightweight compact unit that can be easily removed and replaced with a cover having a fresh new printed appearance. As a person's interests or style changes, he or she may wish to update the printed appearance of his or her Murphy bed with a cover having a different printed look. Perhaps a cover adorned with printed imagery suited for a particular holiday or season may be exchanged for an existing cover during these special times of year. A family picture on the front of a Murphy bed may bring back fond memories for the user of this unique front cover system. The unique system has various aspects and embodiments.

In one aspect of the present invention, a lightweight, printable, interchangeable, vertically retractable front cover system for a Murphy bed assembly comprising: a Murphy bed assembly comprising a plurality of horizontal supports extending between a plurality of vertical supports, wherein the plurality of vertical supports is spaced apart to accommodate a Murphy bed frame, further comprising a Murphy bed frame with lightweight supportive slats or foundation, a base frame, a wall mount adapter and mattress wherein the Murphy bed frame is pivotally positionable along an arched path from a upright position between the plurality of vertical supports and under the plurality of horizontal supports to a lowered position upon a supporting surface and the supportive base frame mounted to either the floor or the wall; a lightweight cover assembly comprising an elongated axis having two opposing distal ends; wherein each distal end rotatably and removably connects to the Murphy bed assembly, and wherein a vertically positionable cover is rotatably mounted to the elongated axis or tube, wherein the positionable cover is vertically retractable and positionable in a deployed position and a retracted position, whereby while in the deployed position the cover conceals the front of the upright Murphy bed frame and while in the retracted position the cover is beyond the arched path of the Murphy bed frame, wherein the cover comprises a continuous flexible sheet of material having a printable surface; further comprising a cordless spring assisted cover drive assembly operably connected to the cover and a projector rod removably connected to the Murphy bed assembly for further aiding in the positioning of the vertically retractable printable cover; and printed digital imagery on the printable surface of the cover.

In another aspect of the present invention, a lightweight, printable, interchangeable, vertically retractable front cover system for a Murphy bed assembly comprising: a Murphy bed assembly comprising a plurality of horizontal supports extending between a plurality of vertical supports, wherein the plurality of vertical supports is spaced apart to accommodate a Murphy bed frame, further comprising a Murphy bed frame with lightweight supportive slats or foundation, a base frame, a wall mount adapter and mattress wherein the Murphy bed frame is pivotally positionable along an arched path from a upright position between the plurality of vertical supports and under the plurality of horizontal supports to a lowered position upon a supporting surface and the supportive base frame is mounted to either the floor or the wall; a lightweight cover assembly comprising a vertically positionable cover comprising a continuous sheet of material having a plurality of horizontal folds to allow for flex in the cover during folding deployment and folding retraction of the cover removably connected to the Murphy bed assembly, wherein the positionable cover is vertically retractable and positionable in a deployed position and a retracted position, whereby while in the deployed position the cover conceals the front of the upright Murphy bed frame and while in the retracted position the cover is beyond the arched path of the Murphy bed frame, wherein the cover comprises a continuous foldable flexible sheet of material having a printable surface; further comprising an electric motor cover drive assembly operably connected to the vertically retractable cover to aid in the positioning thereof; and printed digital imagery on the printable surface of the cover.

In another aspect of the invention, further comprising of a method of providing lightweight printable, interchangeable, vertically retractable front cover system for an existing Murphy bed assembly comprises: the initial step of removing a pre-existing front cover system comprising of bi-fold doors wherein the existing cover is not a structurally supportive component of the bed itself; additionally providing cover framing assembly materials (i.e. wood trim or wood filler) to conceal the screw holes left behind from the removed bi-fold doors and to frame the edges of a positionable cover; also providing a cover assembly having a seamless cover (printable surface) that can be vertically retracted and vertically positioned, with one embodiment of the invention the cover may be rolled about an elongated axis (roller tube) like that of a retractable roller window shade having two opposing distal ends, wherein each distal end rotatably and removably connects to a mount configured for the printable surface to move from a deployed position to a retracted position whereby when deployed the cover conceals from view the upright bed frame and whereby when retracted the cover is beyond the arched path of the existing Murphy bed frame; and complementarily attaching each mount (i.e. end brackets) to the side panels or main header of the existing Murphy bed assembly; providing a cordless spring assisted cover drive assembly, like that of a cordless retractable roller window shade; and providing printed imagery on the printable surface of the positionable cover .

Other embodiments of the invention may include a tubular electric motor and wired or wireless remote switch, or a cord and clutch as the cover drive assembly component for the elongated axis variation or roller type previously discussed. Additionally, the folding variation previously discussed may include yet another embodiment having a cord and clutch manual drive assembly.

In each of the aforementioned embodiments and aspects of the invention, a cover framing assembly may be included at the uppermost portion of the Murphy bed assembly to further enhance the interchangeability of the invention. The cover framing assembly may be mounted to the plurality of vertical supports of the Murphy bed assembly so as to form a gap between the cover framing assembly and the plurality of horizontal supports, wherein the gap receives the positionable cover, wherein the cover framing assembly further comprises a slotted resting place for slidably receiving the opposing ends of a horizontal support of the cover assembly without the use of tools. The cover assembly with a supportive head rail may be attached to the horizontal support with a set of pre-positioned brackets in order to facilitate a simple attachment and detachment method that does not require tools to replace one cover with another. For the first time a Murphy bed user can simply and easily update the appearance of their Murphy bed by quickly exchanging an existing cover with another having a fresh new printed appearance.

These and other features, aspects and advantages of the present invention may become better understood with reference to the following drawings, description and claims.

BRIEF DESCRIPTION OF THE DRAWINGS

FIG. 10 is a section view of an exemplary embodiment of the present invention, illustrating the removably mounted cover assembly in the retracted position and the Murphy bed frame assembly in the lowered position, also illustrating the possible storage position of a projector rod that may be used to aid in deploying and in initiating the retraction of the cover of the cover assembly, and additionally illustrating a gap provided between a main header and a top face frame for a printable surface to pass through;

FIG. 11 is a section view of an exemplary embodiment of the present invention, illustrating the cover assembly removably mounted with end brackets below the main header whereby the main header is positioned at the top of the Murphy bed assembly;

FIG. 12 is a section view of an exemplary embodiment of the present invention, illustrating the cover assembly removably mounted with end brackets at the inside top of opposing side panels whereby the main header is positioned lower than in FIG. 11 and whereby a gap is provided for the printable surface to pass through;

FIG. 13 is a prior art detailed view of a roller and cordless spring assisted drive assembly also used by a cordless retractable roller window shade which may be used in the retraction and deployment of the present invention. Other drive assemblies may be used in further embodiments of the present invention; and FIG. 14 is a prior art detailed view of a tubular electric motor drive assembly also used in a motorized retractable roller window shade, pictured with a remote control switch, both of which may be used in the retraction and deployment of the present invention. Other drive assemblies may be used in further embodiments of the present invention

DETAILED DESCRIPTION OF THE INVENTION

Figure 1:
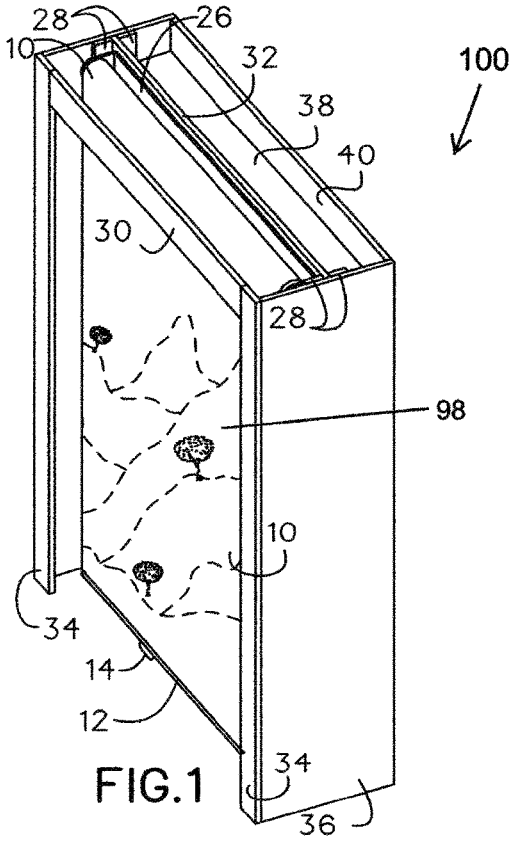
FIG. 1 is a perspective view of an exemplary embodiment of the present invention, illustrating a Murphy bed cover system with a preferred cordless, vertically retractable and vertically positionable cover assembly in a deployed position and removably mounted to a preferred cover framing assembly.
Figure 2:
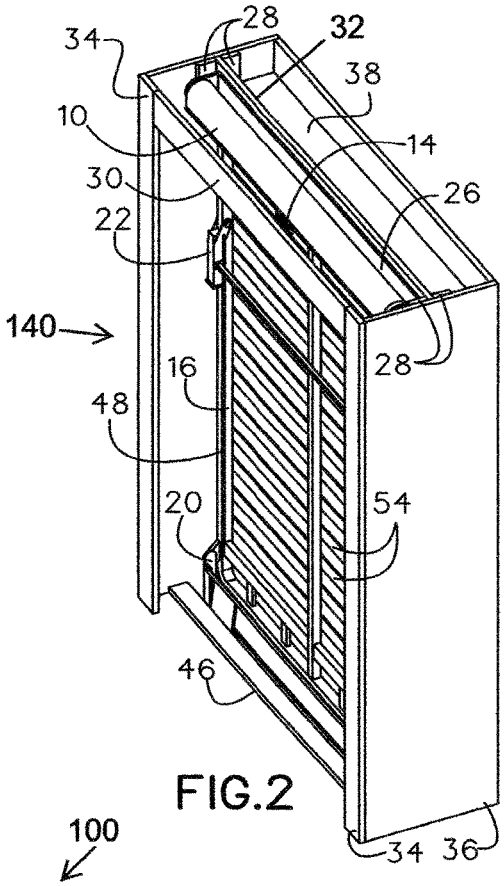
FIG. 2 is a perspective view of an exemplary embodiment of the present invention, illustrating the removably mounted cover assembly in a retracted position and illustrating a Murphy bed assembly with a Murphy bed frame having lightweight slats and no heavy cover where by the bed frame is in the upright position.
Figure 3:
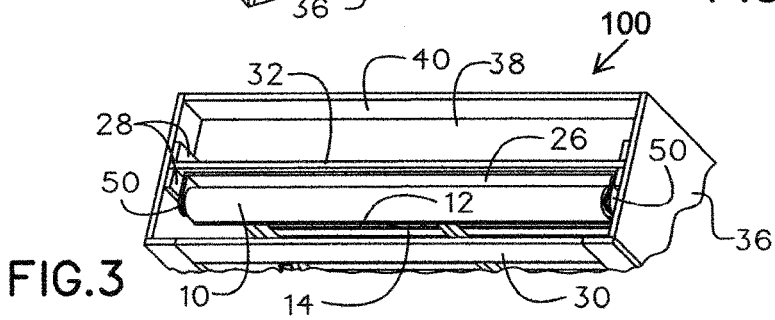
FIG. 3 is a top perspective detailed view of an exemplary embodiment of the present invention.
Figure 4:
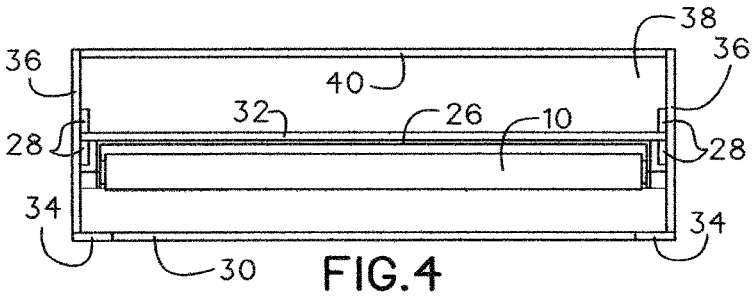
FIG. 4 is a top view of an exemplary embodiment of the present invention.

The present invention is a front cover system for Murphy beds that merges traditional concepts with modern digital technology. Murphy beds generally have had a traditional wood cabinet appearance when stowed away for later use. Traditionally, heavy front wood covers provided to conceal an upright Murphy bed are not simple to quickly remove and replace to transition from one appearance to another. The present invention allows the end user the opportunity to easily change the appearance of their stowed Murphy bed by providing a front cover system that combines digital print technology of today, retracting methods typically used for window treatments, and traditional Murphy bed concepts of yesteryear.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

In one aspect of the present invention comprises a lightweight, printable, interchangeable, vertically retractable front cover system for a Murphy bed assembly, the system comprising a Murphy bed assembly (having no cover like panel(s) attached beneath the bed frame), a cover assembly, a cover framing assembly, a cover drive assembly and graphic printing on the printable surface of the cover assembly. The system comprises a Murphy bed assembly that may include a bed frame (typically made of tubular steel or angle iron) preferably having self-actuating leg(s) supporting the foot end of the bed frame and preferably having a base frame (typically made of steel) supporting the head end of the bed frame. The Murphy bed frame may preferably have lightweight supportive slats (typically made of wood), or optionally a Bunkie board or plywood, that may serve as a mattress support whereby the slats or the like may be attached along the top side of the horizontally positioned bed frame. The system may further include a mattress, a base frame and a wall mount adapter, whereby the base frame may be attached to the wall by way of the wall mount adapter or optionally to the floor. Also, included in the Murphy bed assembly may be side panels that conceal from view the sides of an upright Murphy bed frame and mattress. The Murphy bed frame may be detached from the side panels of the Murphy bed assembly. The bed frame may be pivotally adapted to move from an upright position adjacent a wall to a lowered position upon a supporting surface, such as a floor, along an arched path. Furthermore, a cover assembly having a lightweight seamless positionable cover with a printable surface may be included. With one embodiment of the invention, the cover assembly may have the following characteristics: the positionable cover having a printable surface may be retracted about an elongated axis (i.e. roller tube) having two opposing distal ends that rotatably and removably connect to a mount configured for the printable surface to move from a deployed position to a retracted position; a mount for the cover assembly may consist of end brackets connected with a supportive head rail; the head rail may be attached with a plurality of brackets to a support board. One embodiment of the invention may have optimum interchangeability of the front cover by providing a unique cover framing assembly which includes a support board previously mentioned. With this embodiment the distal ends of the support board, with cover assembly attached to the support board with a plurality of brackets, may rest in a slot provided with a plurality of vertically positioned slot blocks attached to the upper portion of opposing side panels of the Murphy bed assembly and above the horizontally positioned main header. The cover assembly and the cover drive assembly may be hidden from view and a gap between the top face frame and main header may be provided for the cover to pass. The printable surface of the cover assembly may thus move vertically back and forth from a retracted position to a deployed position through the gap provided. In the retracted position the printable surface and the entire cover assembly may be disposed beyond the arched path of the bed frame. Along with the support board, the cover framing assembly may include nesting slot blocks, the upper portion of the side panels, main header, and wall anchor board. Various cover drive assemblies may be used in various embodiments of the invention. One primary embodiment of the roller configured cover system may have a cover drive assembly like that of a spring assisted cordless retractable roller window shade which may aid in the retraction and deployment of the printable surface or positionable front cover. Other optional drive assemblies that may be used with the roller cover variation may be a tubular electric motor, like that of a motorized roller window shade, or a cord and clutch, like that of a corded roller window shade. Another embodiment of the invention may have a foldable printable positionable cover like that of a retractable cellular window shade, having a foldable continuous series of tubes. The foldable printable positionable cover may alternatively be a thin continuous lightweight sheet of material having a plurality of closely spaced parallel horizontal folds that may flex together when folded and flex apart when unfolded like an accordion. With the folding configuration, either of two drive assemblies may complete this embodiment. The drive assemblies are an electric motor, with a wired or wireless switch, and a cord and clutch; both drive assemblies are presently used with retractable cellular window shades and other folding style window shades. Printed imagery on the printable surface of the interchangeable vertically retractable and positionable cover may be included to enhance the appearance of the Murphy bed.

In another aspect of the present invention, a lightweight, printable, interchangeable, vertically retractable front cover system for a Murphy bed assembly comprising In one aspect of the present invention, a method of providing a Murphy bed assembly with a printable interchangeable vertically retractable front cover system comprises several steps: providing a Murphy bed assembly with a Murphy bed frame preferably having lightweight supportive slats for the mattress support and having no cover like panel(s) attached beneath the bed frame, whereby the bed frame at the head end is supported by a base frame which rests on the floor and whereby at the foot end is supported by at least one leg resting on a supportive floor whereby the base frame is secured to the floor and/or the base of the wall. The bed frame may be pivotally adapted to move from an upright position adjacent a wall to a lowered position upon a floor along an arched path. Another step may be providing a cover assembly having a continuous seamless cover (printable surface) that can be vertically retracted, and with one embodiment of the invention rolled about an elongated axis (roller tube) like that of a retractable roller window shade having two opposing distal ends, wherein each distal end rotatably connects to a mount configured for the printable surface to move from a deployed position to a retracted position; and complementarily attaching each mount to a provided cover framing assembly for the printable surface when deployed to conceal the front of the Murphy bed when the bed is upright and for the printable surface and the entire cover assembly to be disposed beyond the arched path of the bed when the cover (printable surface) is retracted. An optional configuration of the invention may provide a cover assembly having a foldable cover (foldable printable surface), a folding retracting method and a cover drive assembly configured to fold the cover, like that of a retractable cellular window shade. An important step that may give a traditional bed a fresh new look may be to apply graphic printing to the printable surface. An additional step that may have various configurations may be providing a cover drive assembly, that may assist the user in the vertical retraction and deployment of the cover (printable surface), like that of a coiled spring cordless retractable roller window shade, a motorized cordless retractable roller window shade, a corded retractable roller window shade, a corded retractable cellular (folding) window shade, or a motorized retractable cellular (folding) window shade. One embodiment of the invention may include the step providing a cover framing assembly configured especially for optimum interchangeability with a slotted resting place above the main header which allows the end user to conveniently lift one cover assembly out and set a replacement cover assembly back in its designated slot with minimal or no use of tools. Additionally, this cover framing configuration may have space to conceal from view the cover assembly and cover drive assembly and may have a gap between the top face frame and main header for the cover to pass when vertically retracted and deployed. In other embodiments of this invention, the cover assembly including the cover drive assembly may be mounted in an alternate location such as beneath an elevated main header or to the inside face of the opposing side panels of the Murphy bed assembly with end brackets.

In another aspect of the present invention, a method of replacing an existing front cover system on an existing Murphy bed assembly with a printable interchangeable vertically retractable front cover system, comprises the initial step of removing a pre-existing front cover system (bi-fold doors) from the existing Murphy bed assembly, in the case of the existing Murphy bed assembly having an existing cover system (i.e. bi-fold doors) that is not a structurally supportive component of the bed itself. Additional cover framing assembly materials (i.e. trim or wood filler) may be provided to conceal the screw holes left behind from the removed bi-fold doors and/or to further conceal a newly installed cover assembly and cover drive assembly. The existing Murphy bed assembly would additionally have a bed frame that remains wherein that bed frame pivots to move from an upright position adjacent a wall to a lowered position upon a floor along an arched path. Another step may be providing a cover assembly having a seamless cover (printable surface) that can be vertically retracted, and with one embodiment of the invention rolled about an elongated axis (roller tube) like that of a retractable roller window shade having two opposing distal ends, wherein each distal end rotatably connects to a mount configured for the printable surface to move from a deployed position to a retracted position; and complementarily attaching each mount to the side panels or main header of the existing Murphy bed assembly (not the bed frame). When deployed, the new front cover (printable surface) may conceal the front of the Murphy bed when the bed is upright and the printable surface and the entire cover assembly may be disposed beyond the arched path of the bed when the cover (printable surface) is retracted. An optional configuration of the invention may provide a cover assembly having a foldable cover (foldable printable surface), a folding retracting method and a cover drive assembly configured to fold the cover, like that of a retractable cellular window shade. An important step that may give a traditional bed a fresh new look may be to apply graphic printing to the printable surface. An additional step that may have various configurations may be providing a cover drive assembly, that may assist the user in the vertical retraction and deployment of the cover (printable surface), like that of a coiled spring cordless retractable roller window shade, a motorized cordless retractable roller window shade, a corded retractable roller window shade, a corded retractable cellular (folding) window shade, or a motorized retractable cellular (folding) window shade. In other embodiments of this invention, the cover assembly including the cover drive assembly may be mounted in an alternate location such as beneath an elevated main header or to the inside face of the opposing side panels of the Murphy bed assembly with end brackets. Optionally, a decorative head rail cover may be attached to the existing main header or side panels on the existing Murphy bed assembly to conceal the cover assembly.

Broadly, the present invention may provide a printable interchangeable vertically retractable front cover system for a Murphy bed. Such a system may provide a cover assembly, a cover framing assembly, a cover drive assembly, and a Murphy bed assembly. The cover assembly may vertically deploy to conceal a Murphy bed in the upright position and may vertically retract for the bed frame to be lowered to the floor. The cover assembly may include a positionable cover having a continuous seamless printable surface that may have high resolution digital imagery printed on it such as photographs and artwork. The positionable cover may either roll up or fold up (vertically retract) into a compact cover assembly which may be uniquely removably mounted to the cover framing assembly to allow for quick and easy transition from one cover assembly to another, thus making it uniquely interchangeable. For the first time, a Murphy bed owner may have the ability to quickly update the appearance of their stowed Murphy bed, such as with changing seasons, styles or interests. The cover may vertically retract with the aid of its own drive assembly.

Referring to FIGS. 1 through 14, the present invention may include a Murphy bed cover system 100. The Murphy bed cover system 100 may include a cover assembly 110, a cover framing assembly 120, a cover drive assembly 130, and a Murphy bed assembly 140. Some components of the cover framing assembly 120 may be shared with the Murphy bed assembly 140, such as the main header 38, wall anchor board 40, the top face frame 30, and the side panels 36. The cover drive assembly 130 may include a spring assisted cordless retractable roller window shade, as illustrated in FIG. 13, or a tubular electric motor and remote switch typically used to raise and lower a motorized retractable roller window shade, as illustrated in FIG. 14. A plurality of horizontal supports may include the main header 38, the wall anchor board 40 and the top face frame 30.

As illustrated in FIGS. 1 and 2 and FIGS. 6 through 10, the Murphy bed assembly 140 may include a bed frame 16, a mattress 18, a base frame 20, at least one self-actuating leg 22, a top face frame 30 (and optional bottom face frame), side face framing 34, two side panels 36, a headboard 42, a lower rear support board 44, an inset lower front support flat bar/board 46, a bar 48 and a wall mount adapter 52. The Murphy bed assembly 140 is pivotally adapted to move the bed frame 16 and the mattress 18 from an upright position adjacent a wall to a lowered position upon a supporting surface, such as a floor, along an arched path 96. A plurality of vertical supports may comprise the side face framing 34 and the two side panels 36.

The two side panels 36 are disposed and extended generally vertically above a horizontal floor. The two side panels 36 are spaced to accommodate the bed frame 16, base frame 20 and the mattress 18 and the two side panels 36 are substantially parallel to each other. The two side panels 36 typically do not engage the Murphy bed frame 16 and the floor or wall mounted base frame 20 components of the Murphy bed assembly 140. The Murphy bed assembly 140 may be generally connected with a plurality of fasteners such as screws, bolts, nails and quick connect cam locks.

Figure 5A:
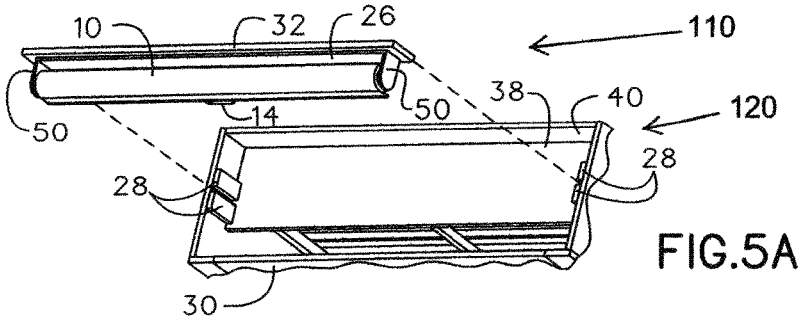
FIG. 5A is a top perspective exploded view of an exemplary embodiment of the present invention, illustrating the cordless vertically retractable and positionable cover assembly positioned above a removable connection and sliding resting place of the cover framing assembly.
Figure 5B:
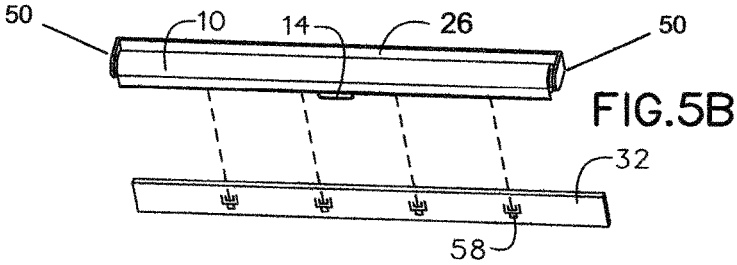
FIG. 5B is an exploded detailed view of an exemplary embodiment of the present invention, illustrating the cordless vertically retractable and positionable cover assembly including a supportive head rail removably connected to a support board of the cover framing assembly.
Figure 6:
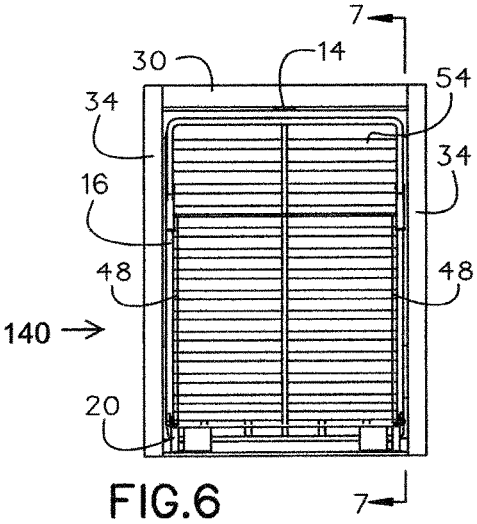
FIG. 6 is a front view of an exemplary embodiment of the present invention, illustrating the Murphy bed assembly including the Murphy bed frame in the upright position with the cover assembly hidden from view in the retracted position.
Figure 7:
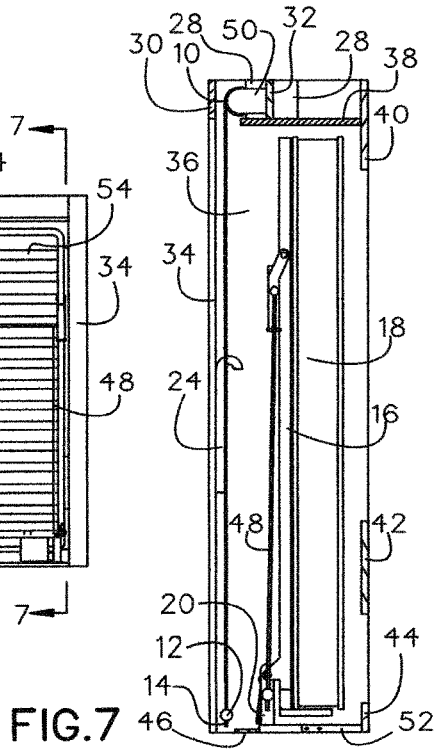
FIG. 7 is a section view of an exemplary embodiment of the present invention along line 7-7 in FIG. 6, illustrating the removably mounted cover assembly in the deployed position and the Murphy bed assembly including the Murphy bed frame in the upright position.
Figure 8:
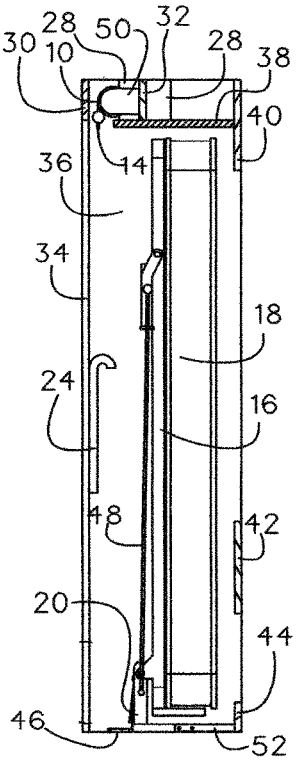
FIG. 8 is a section view of an exemplary embodiment of the present invention along line 7-7 in FIG. 6, illustrating the removably mounted cover assembly in the retracted position and the Murphy bed assembly including the Murphy bed frame in the upright position.
Figure 9:
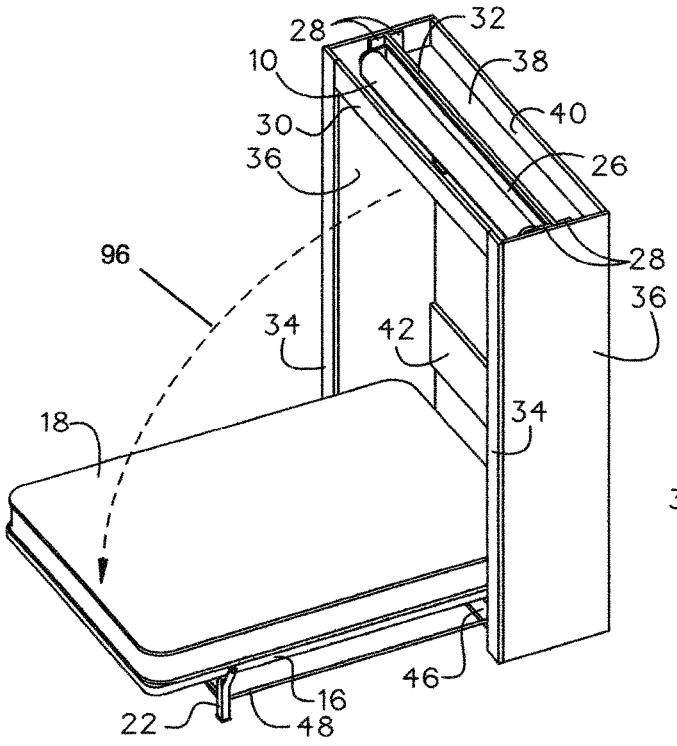
FIG. 9 is a perspective view of an exemplary embodiment of the present invention, illustrating the removably cover assembly in the retracted position and a Murphy bed frame in a lowered position, also illustrating the arched pathway of the Murphy bed frame moving from the upright position to the lowered position.
Figure 10:
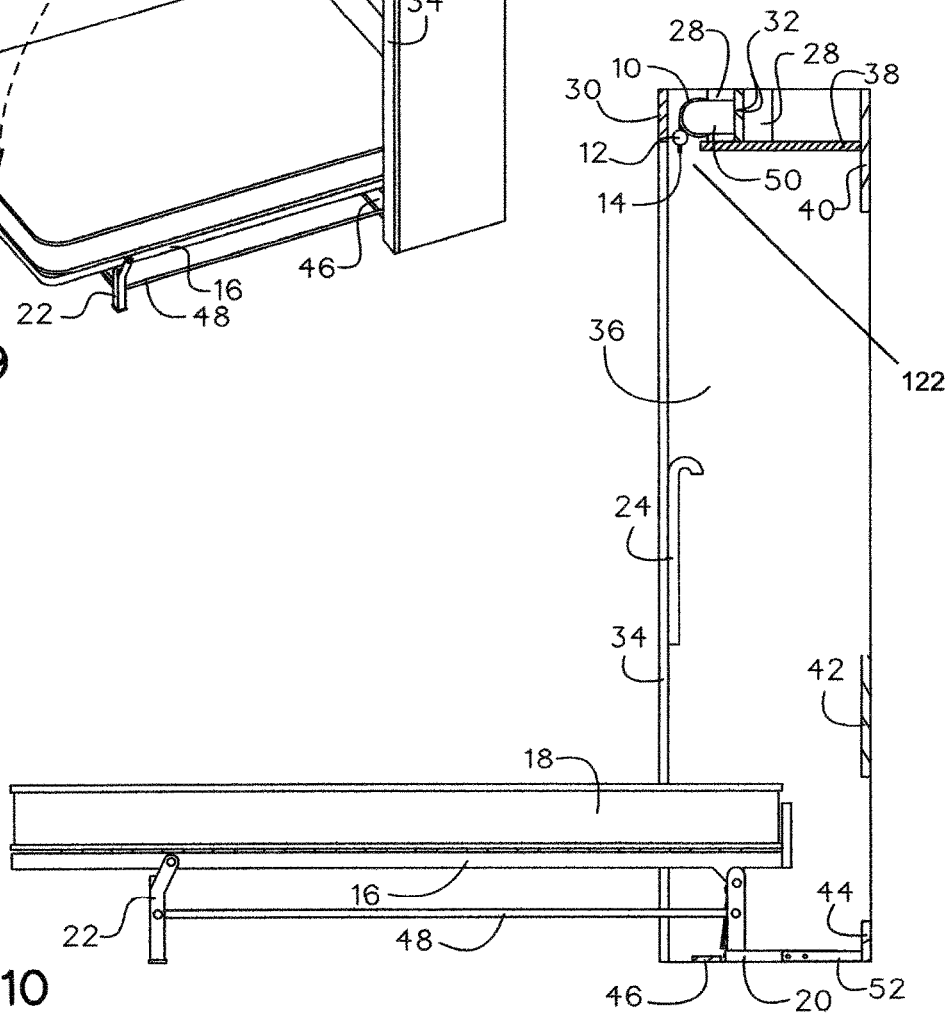

As illustrated in FIGS. 1 through 5B and FIGS. 7 through 12, the cover assembly 110 may include a positionable cover 10 having a printable surface 98. The positionable cover 10 may be adapted to rotatably wind about an elongated axis (roller tube) so as to be vertically positionable from a retracted position to a deployed position. The printable surface 98 may provide a continuous sheet having no gaps, no noticeable seams or uneven surfaces so as to facilitate a plurality of printing techniques, including graphical printing. Vertically positionable may mean moving upwardly from to the supporting surface in a direction normal thereto, and vice versa. Near the lower distal end of the positionable cover 10, a bottom rail 12 and a handle 14 may be provided. The bottom rail 12 may prevent the positionable cover 10 from losing its generally rectangular shape. The projector rod 24 may be provided to pull down and push down the handle 14 when positioning the positionable cover 10 to and from the deployed position. The projector rod 24 may be removably connected to the Murphy bed assembly 140, as illustrated in FIG. 8. As illustrated in FIG. 5B, the positionable cover 10 may be rotatably mounted at its distal ends to two end brackets 50 and thus attached to a supportive head rail 26 and then to brackets 58 that are positioned on a support board 32 of the cover framing assembly 120. In this preferred embodiment, the brackets 58 allow the head rail 26 and thus the cover assembly 110 to be removably attached or detached without the use of tools by the end user. Once the positionable cover 10 is mounted to support board 32, it may be simply placed from above in between the slot blocks 28 thus coming to rest on the main header 38 without the use of additional fasteners, thereby providing a slotted resting place so that the cover assembly 110 is easily interchangeable with another. With this embodiment, the cover assembly 110 can likewise be removed quickly without the use of tools. In certain embodiments, the cover assembly 110 may be a retractable cellular window shade, as illustrated in FIG. 13, or any other means of providing the printable surface 98 that moves vertically to and from the retracted position and the deployed position. All components of the cover assembly 110 may be generally connected with fasteners such as screws.

As illustrated in FIGS. 5A, the cover framing assembly 120 may include two pair of nesting slot blocks 28, a main header 38, a wall anchor board 40, and a support board 32 that is illustrated pre-attached to the cover assembly 110. The cover framing assembly 120 may be adapted to form a gap illustrated in FIG. 12 that provides a space between the top face frame 30 and the main header 38, which gives clearance for the positionable cover 10 and thus the printable surface 98 to pass during deployment and retraction. The wall anchor board 40 and the main header 38 may extend between and so as to connect at each end to the two side panels 36 of the Murphy bed assembly 140. The cover framing assembly 120, which partly includes the wall anchor board 40, the support board 32 and the main header 38, may be sized to provide support for axial loads resulting from self-weight of the cover assembly 110, of the cover framing assembly 120, and of the cover drive assembly 130. The main header 38 may be generally perpendicularly joined to the wall anchor board 40. A pair of nesting slot blocks 28 may be attached on each inside opposing face of side panels 36. The slot blocks 28 may be connected to the two side panels 36 immediately above the intersection of the main header 38 and the two side panels 36, as illustrated in FIG. 5A. Each nesting slot block 28 may be adapted to slidably receive each distal end of the support board 32. The support board 32 may be connected to the head rail 26 of the cover assembly 110 as illustrated in FIG. 5B by a plurality of rail brackets 58.

As illustrated in FIGS. 11 and 12, in some cases the main header 38 may perpendicularly connect to the wall anchor board 40 at different attachment planes relative to the supporting surface and may additionally connect to the top face frame 30 as seen in FIG. 11. In certain alternative embodiments, the end brackets 50 may mount directly to the underside of the main header 38 as illustrated in FIG. 11 or directly to the side panels as illustrated in FIG. 12. The end brackets 50 may connect with or without an optional head rail 26. All parts of the cover framing assembly 120 may be generally connected with a plurality of fasteners such as screws, nails, and/or quick cam locks.

The Murphy bed cover system 100 may include in an optional embodiment of the invention with an electric motor with a remote control switch for the cover drive assembly 130. As illustrated in FIGS. 13 and 14, the cover assembly 110 may include wall/ceiling mount bracket 64, a mounting rail 66, a roller tube 68, a spring 70, an adjustable top stop 72, a top stop adjustment and bracket 74, a hem pocket and weight bar 76, an exposed hem bar with 16" pull cord kit 78, a bracket A 80, a bracket B 82, a transmission 84, an external tube 86, an electric motor 88 and a remote control 90.

The printable surface 98 of the cover may be made of material that provides a suitable medium and surface for use with modern printers to give users the option of applying custom printed artwork, printed digital photographs, or logos thereto so as customize the look of the front face and/or cover of the Murphy bed assembly 140.

It should be understood, of course, that the foregoing relates to exemplary embodiments of the invention and that modifications may be made without departing from the spirit and scope of the invention as set forth in the following claims.

What is claimed is:

1. A lightweight, printable, interchangeable, vertically retractable front cover system for a Murphy bed assembly comprising:

a Murphy bed assembly comprising a plurality of horizontal supports extending between a plurality of vertical supports, wherein the plurality of vertical supports is spaced apart to accommodate a Murphy bed frame, further comprising a Murphy bed frame with lightweight supportive slats or foundation, a base frame, a wall mount adapter and mattress wherein the Murphy bed frame is pivotally positionable along an arched path from a upright position between the plurality of vertical supports and under the plurality of horizontal supports to a lowered position upon a supporting surface and the supportive base frame mounted to either the floor or the wall;

a lightweight cover assembly comprising an elongated axis having two opposing distal ends; wherein each distal end rotatably and removably connects to the Murphy bed assembly, and wherein a vertically positionable cover is rotatably mounted to the elongated axis or tube, wherein the positionable cover is vertically retractable and positionable in a deployed position and a retracted position, whereby while in the deployed position the cover conceals the front of the upright Murphy bed frame and while in the retracted position the cover is beyond the arched path of the Murphy bed frame, wherein the cover comprises a continuous flexible sheet of material having a printable surface; further comprising a cordless spring assisted cover drive assembly operably connected to the cover; and printed digital imagery on the printable surface of the cover, whereby the cover can be customizable.

2. The assembly of claim 1, further including a projector rod with a "S" curve shaped operable end and opposing end handle to reach for and engage with the center handle or loop on the bottom rail of the printable cover of the cover assembly in order to pull down or push down on such cover to move the cover to a deployed position.

3. The assembly of claim 1, further including a pair of end brackets for removably mounting the distal ends of the elongated axis or tube of the cover assembly to the Murphy bed assembly.

4. The assembly of claim 1, further including a cover framing assembly mounted to the plurality of vertical supports of the Murphy bed assembly so as to form a gap between the cover framing assembly and the plurality of horizontal supports, wherein the gap receives the printable surface.

5. The assembly of claim 4, wherein the cover framing assembly further comprises a slotted resting place for slidably receiving the opposing ends of a horizontal support board having the cover assembly pre-attached along the length thereof whereby the cover assembly can be easily interchangeable without the use of tools.

6. The assembly of claim 1, further including a horizontal support board for removably mounting the head rail and cover assembly along the length thereof without the use of tools.

7. The assembly of claim 1, further including a supportive head rail for rotatably attaching to the distal ends of the elongated axis or tube of the cover assembly.

8. The assembly of claim 6, further including a set of brackets pre-attached to the bottom side of a horizontal support of the Murphy bed assembly to removably receive the supportive head rail and cover assembly.

9. The assembly of claim 1, wherein the cordless spring assisted cover drive assembly further comprises a projector rod removably attached to the Murphy bed assembly for additionally aiding in the positioning of the positionable cover using the projector rod.

10. The assembly of claim 1, further including a bottom rail with a center handle or loop attached across the lower horizontal edge of the printable cover whereby the projector rod is engaged with the "S" curved end of the projector rod to either pull down or push down the cover to deploy such cover when a cordless spring assisted cover drive assembly is employed.

11. The assembly of claim 1, further included a tubular electric motor cover drive assembly operably connected to the cover assembly to aid in the vertical deployment and vertical retraction of the cover.

12. The assembly of claim 11, further included a wired or wireless switch for controlling the tubular electric motor.

13. The assembly of claim 1, further including a cord and clutch cover drive assembly operably connected to the cover.

14. A lightweight, printable, interchangeable, vertically retractable front cover system for a Murphy bed assembly comprising:

a Murphy bed assembly comprising a plurality of horizontal supports extending between a plurality of vertical supports, wherein the plurality of vertical supports is spaced apart to accommodate a Murphy bed frame, further comprising a Murphy bed frame with lightweight supportive slats or foundation, a base frame, a wall mount adapter and mattress wherein the Murphy bed frame is pivotally positionable along an arched path from a upright position between the plurality of vertical supports and under the plurality of horizontal supports to a lowered position upon a supporting surface and the supportive base frame is mounted to either the floor or the wall;

a lightweight cover assembly comprising a vertically positionable cover comprising a continuous sheet of material having a plurality of horizontal folds to allow for flex in the cover during folding deployment and folding retraction of the cover removably connected to the Murphy bed assembly, wherein the positionable cover is vertically retractable and positionable in a deployed position and a retracted position, whereby while in the deployed position the cover conceals the front of the upright Murphy bed frame and while in the retracted position the cover is beyond the arched path of the Murphy bed frame, wherein the cover comprises a continuous foldable flexible sheet of material having a printable surface; further comprising an electric motor cover drive assembly operably connected to the vertically retractable cover to aid in the positioning thereof; and printed digital imagery on the printable surface of the cover, whereby the cover can be customizable.

15. The assembly of claim 14, further including a pair of end brackets for removably mounting the distal ends of the cover assembly to the Murphy bed assembly.

16. The assembly of claim 14, further including a wired or wireless switch for controlling the electric motor cover drive assembly.

17. The assembly of claim 14, further including a cord and clutch cover drive assembly operably connected to the vertically retractable cover to aid in the positioning thereof.

18. The assembly of claim 14, further including a supportive head rail rotatably connected to the distal ends of the cover assembly.

19. The assembly of claim 14, further including a set of brackets pre-attached to the bottom side of a horizontal support of the Murphy bed assembly to removably receive the supportive head rail and cover assembly.

* * * * *